US008475217B2

(12) United States Patent
Zhu et al.

(10) Patent No.: US 8,475,217 B2
(45) Date of Patent: Jul. 2, 2013

(54) ELECTRICAL CONNECTOR WITH IMPROVED HOUSING

(75) Inventors: Zi-Qiang Zhu, Kun Shan (CN); Feng Xiong, Kun Shan (CN); Hong-Qiang Han, Kun Shan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 205 days.

(21) Appl. No.: 13/174,804

(22) Filed: Jul. 1, 2011

(65) Prior Publication Data

US 2012/0040562 A1 Feb. 16, 2012

(30) Foreign Application Priority Data

Aug. 10, 2010 (CN) ..... 2010 2 0287409 U
Aug. 10, 2010 (CN) ..... 2010 2 0287959 U

(51) Int. Cl.
*H01R 24/00* (2006.01)
*H01R 13/648* (2006.01)

(52) U.S. Cl.
USPC ..... 439/660; 439/701

(58) Field of Classification Search
USPC ..... 439/660, 701, 607.32, 607.35, 607.39
See application file for complete search history.

(56) References Cited

U.S. PATENT DOCUMENTS

| | | | | |
|---|---|---|---|---|
| 6,176,745 | B1 * | 1/2001 | Furutani | 439/701 |
| 7,811,110 | B2 | 10/2010 | He et al. | |
| 8,011,969 | B2 * | 9/2011 | Wang et al. | 439/660 |
| 8,262,420 | B2 * | 9/2012 | Xiong et al. | 439/701 |
| 2010/0124851 | A1 * | 5/2010 | Xiong et al. | 439/660 |
| 2010/0330849 | A1 * | 12/2010 | Wang et al. | 439/701 |
| 2011/0159746 | A1 * | 6/2011 | He | 439/660 |
| 2012/0040562 | A1 * | 2/2012 | Zhu et al. | 439/626 |

FOREIGN PATENT DOCUMENTS

TW M381187 U1 5/2010

* cited by examiner

*Primary Examiner* — James Harvey
(74) *Attorney, Agent, or Firm* — Wei Te Chung; Ming Chieh Chang

(57) ABSTRACT

An electrical connector includes an insulative housing having a base with two opposite sides and a tongue extending forwardly from the base, a first insulator attached to one side of the base, a second insulator attached to the other side of the base, and a plurality of contacts including a first set of contacts sandwiched between the base and the first insulator, and a second set of contacts sandwiched between the base and the second insulator. The contacts each has a contact portion arranged on the tongue for mating with a corresponding plug.

20 Claims, 8 Drawing Sheets

ELECTRICAL CONNECTOR WITH IMPROVED HOUSING

BACKGROUND OF THE INVENTION

1. Field of the Invention

The present invention relates to an electrical connector, and more particularly to an electrical connector with an improved housing for improving structure strength thereof.

2. Description of Related Art

An electrical connector, mounted on a PCB for electrically connecting with a plug, is typically described in Taiwan Patent No. M381187 issued on May 21, 2010. The electrical connector includes a front housing, a first rear housing, a second rear housing combined to the first rear housing, a plurality of contacts, and a metal shell covering the housings. The front housing has a base and a tongue projecting forwardly from the base. The base defines a pair of positioning holes at a rear end thereof. The first and second rear housings are positioned to each other by a number of projections and slots therebetween and fixed together by the metal shell. The second rear housing has a pair of posts forwardly extending from a front end thereof to engage with the positioning holes of the front housing. The metal shell fixes the front housing and rear housings together along a front-to-back direction. The contacts include a first set of contacts assembled to the first rear housing, and a second set of contacts assembled to the second rear housing. Each of the contacts has a securing portion secured to the rear housings, a tail portion extending downwardly out of the rear housings for being connected with the PCB, and a contact portion extending forwardly beyond the front end of the rear housings. The base of the front housing defines a plurality of passageways extending therethrough along the front-to-back direction. The tongue defines a plurality of slots at two sides thereof corresponding to the passageways. The contact portions of the contacts are arranged in two rows and extend to the slots of the tongue through the passageways along the front-to-back direction when the front housing is assembled to the rear housings. As described above, the front housing is positioned to the rear housing merely via the posts on the second rear housing, however, it is not firm enough, the posts are easily destroyed when the front housing is swayed along a thickness direction of the tongue.

Hence, an improved electrical connector is desired to overcome the above problems.

BRIEF SUMMARY OF THE INVENTION

According to the present invention, an electrical connector, comprises: an insulative housing having a base with two opposite sides, and a tongue extending forwardly from the base; a first insulator attached to one side of the base which defines a plurality of first retaining slots; a second insulator attached to the other side of the base which defines a plurality of second retaining slots; a metal shell covering the housing, the first insulator and the second insulator, and surrounding around the tongue to define a mating port therebetween; and a plurality of contacts including a first set of contacts, and a second set of contacts, the contacts each having a contact portion located at the tongue and exposed to the mating port, a tail portion extending out of the housing, and a retaining portion between the contact portion and the tail portion; wherein the retaining portions of the first contacts are retained in the first retaining slots, the retaining portions of the second contacts are retained in the second retaining slots, respectively.

According to another aspect of the present invention, an electrical connector, comprises: a first set of contacts located in a first vertical plane, each of the first contacts defining a first retaining portion, a first contact portion extending forwardly from a front end of the first retaining portion, and a first tail portion extending from a rear end of the first retaining portion; a second set of contacts located in a second vertical plane parallel to the first vertical plane, each of the second contacts defining a second retaining portion, a second contact portion extending forwardly from a front end of the first second retaining portion, and a second tail portion extending from a rear end of the second retaining portion; an insulative housing including a base, and a tongue extending forwardly from the base for the first and the second contact portions being located on; a first insulator retained on the base to hold the first retaining portions of the first contacts between the first insulator and the base; and a second insulator retained on the base to hold the second retaining portions of the second contacts between the second insulator and the base, and isolated from the first insulator by the base along a thickness direction of the tongue.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
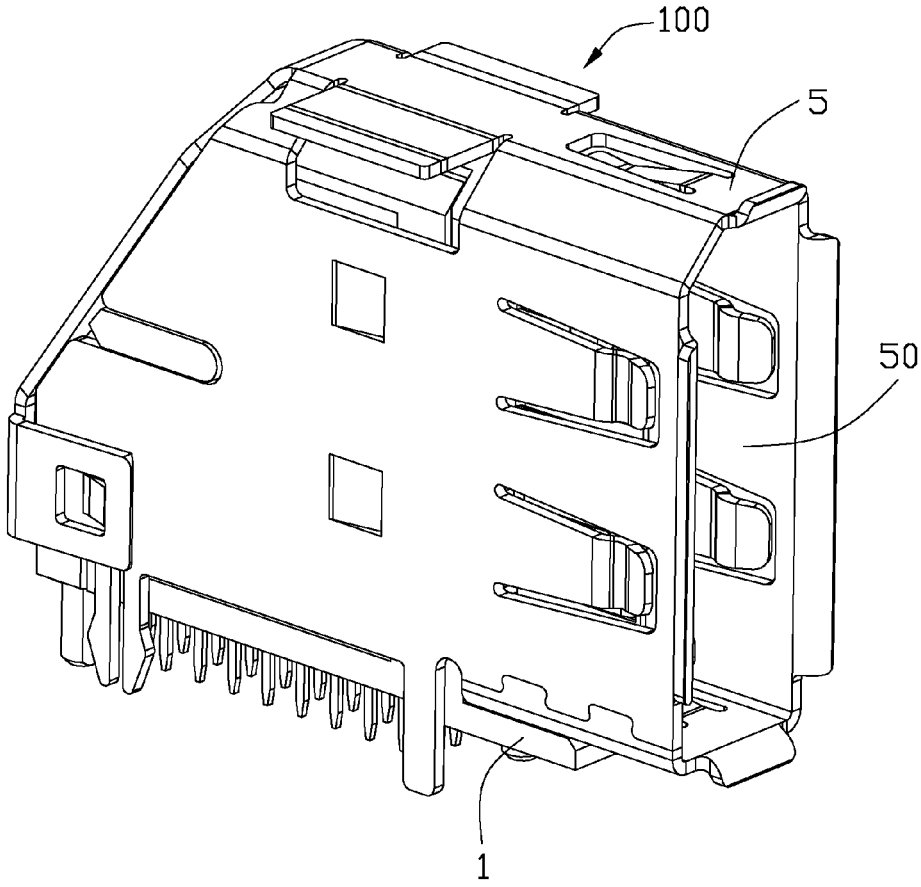
FIG. 1 is a perspective view of an electrical connector according to the present invention.
Figure 2:
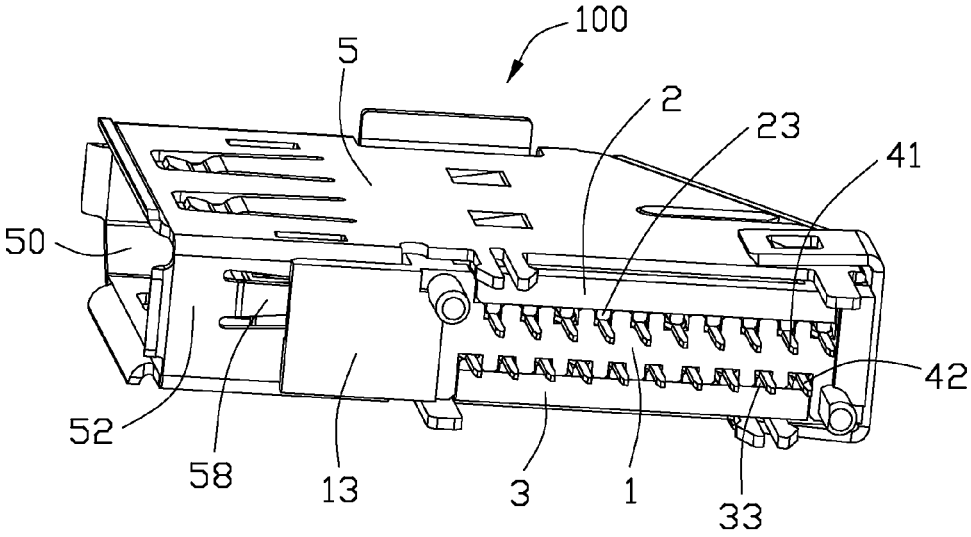
FIG. 2 is a view similar to FIG. 1, while taken from a different aspect.
Figure 3:
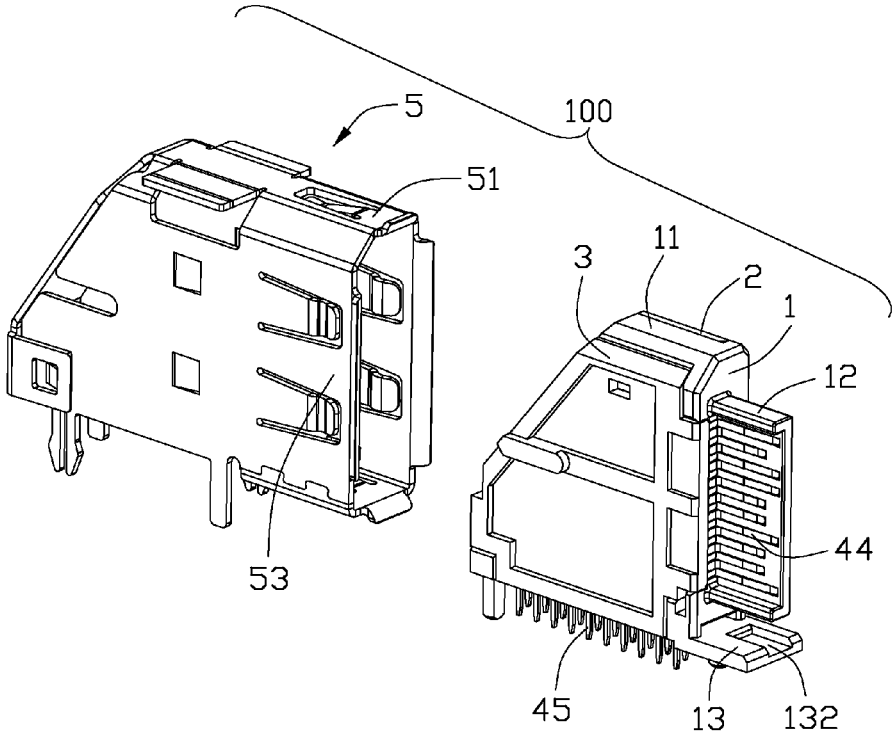
FIG. 3 is a partly exploded view of the electrical connector shown in FIG. 1.
Figure 4:
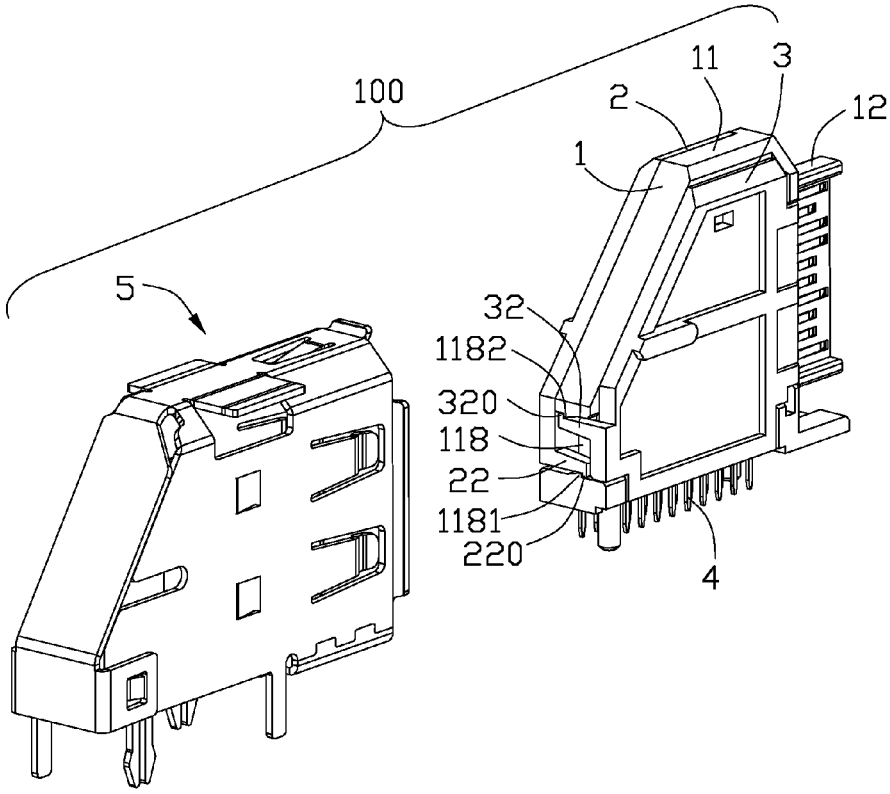
FIG. 4 is a view similar to FIG. 3, while taken from a different aspect.
Figure 5:
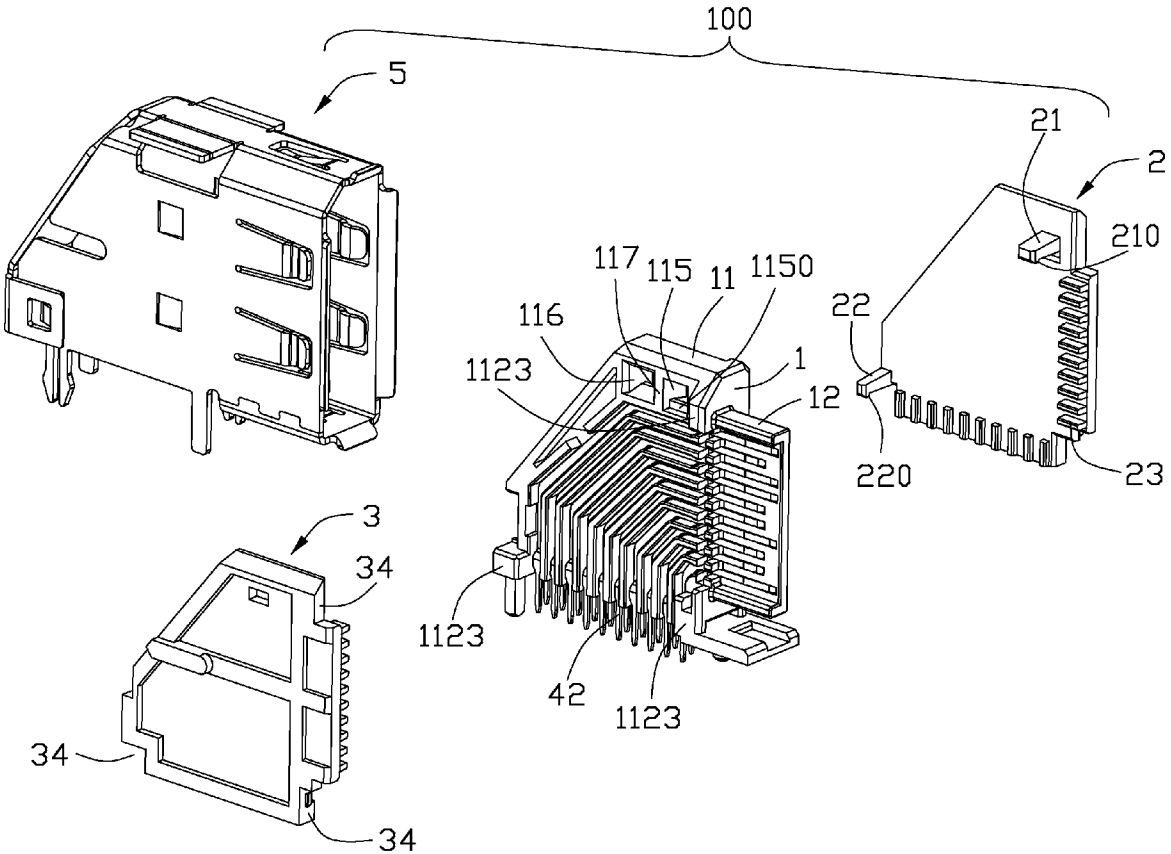
FIG. 5 is a further exploded view of the electrical connector shown in FIG. 3.
Figure 6:
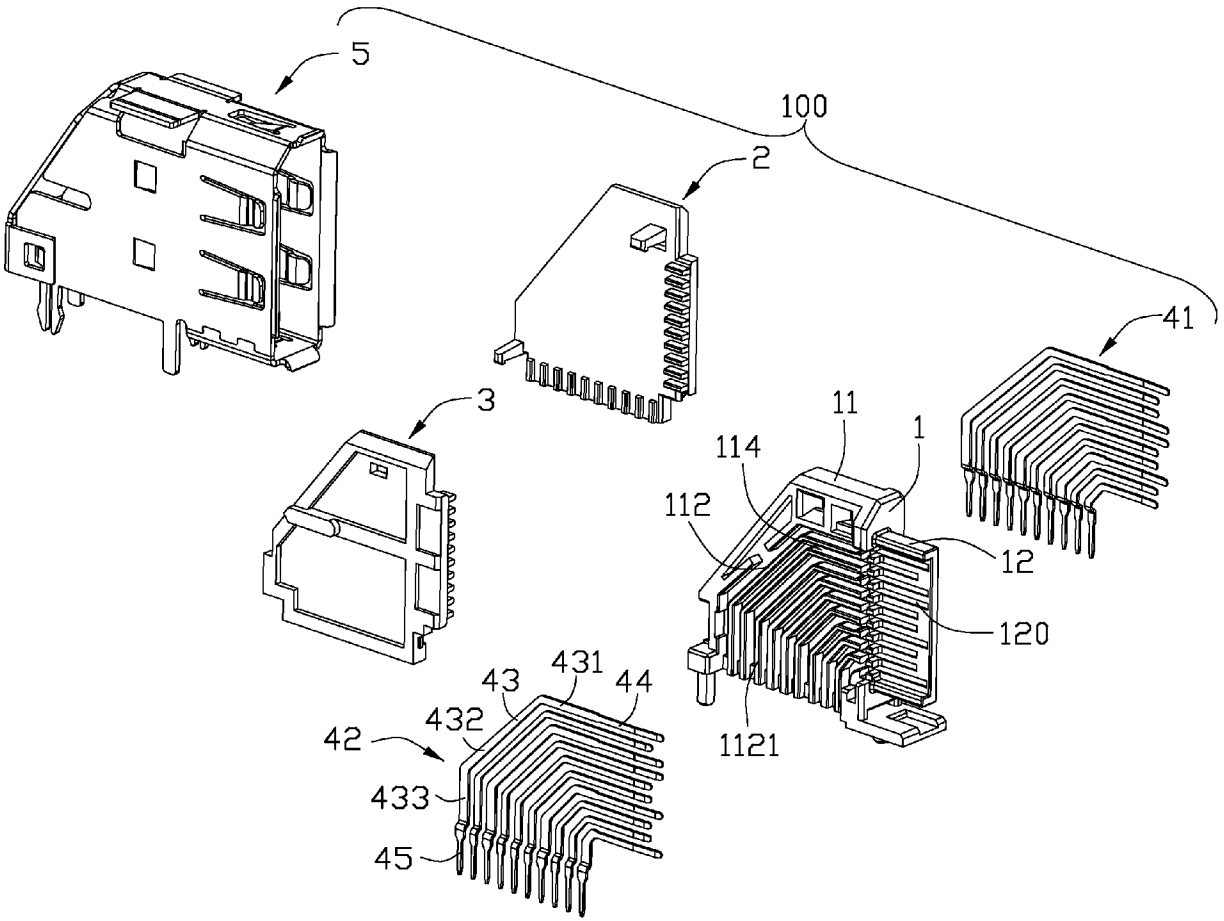
FIG. 6 is an exploded view of the electrical connector shown in FIG. 1.
Figure 7:
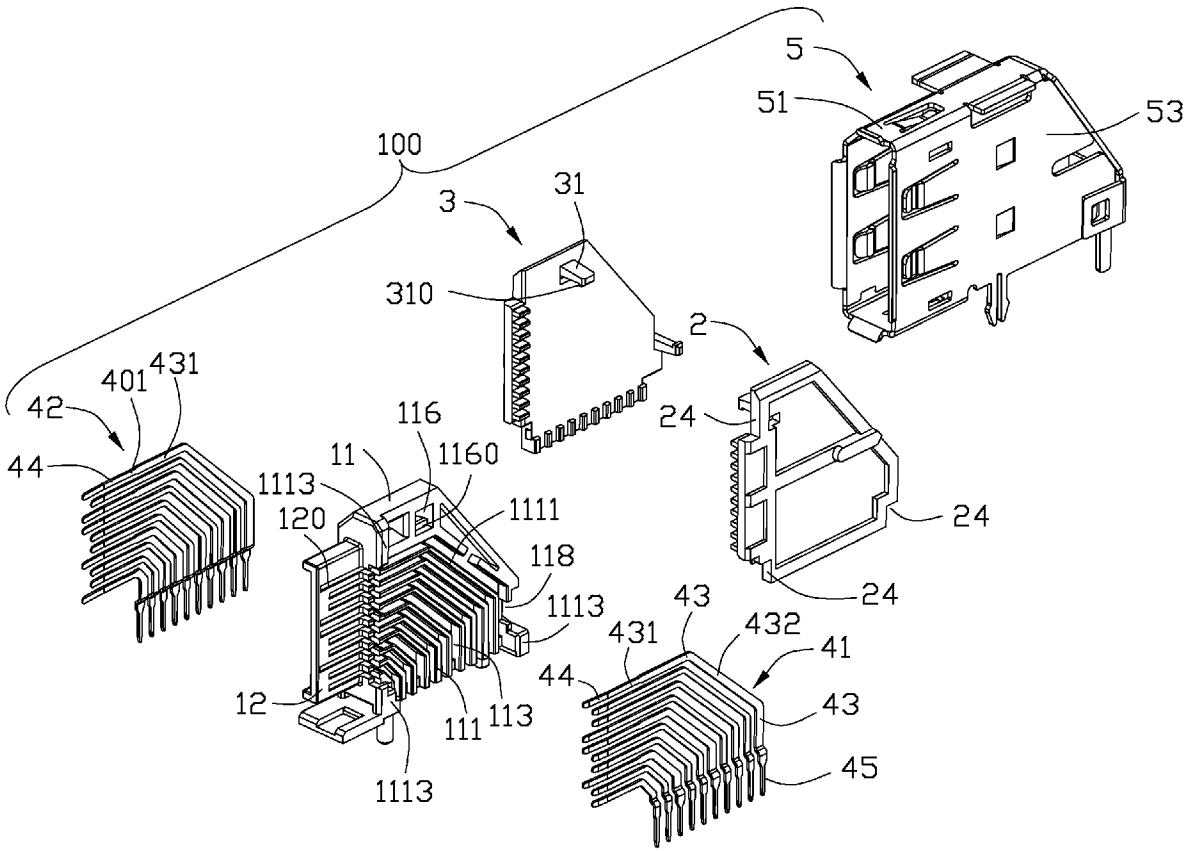
FIG. 7 is a view similar to FIG. 6, while taken from a different aspect.

In the following description, numerous specific details are set forth to provide a thorough understanding of the present invention. However, it will be obvious to those skilled in the art that the present invention may be practiced without such specific details.

Referring to FIGS. 1-7, an electrical connector 100 according to the present invention is disclosed. The electrical connector 100 is an upright DisplayPort connector and is used to be mounted on a PCB (not shown) for receiving a corresponding plug (not shown). The electrical connector 100 comprises an insulative housing 1, a first insulator 2 and a second insulator 3 both of which are retained in the housing 1 respectively, a plurality of contacts 4 retained in the housings 1, and a metal shell 5 covering the housing 1, the first insulator 2 and the second insulator 3.

The housing 1 has a base 11, an upright-plate shaped tongue 12 extending forwardly from the base 11, and a horizontal supporting plate 13 extending forwardly from a lower portion of the base 11. The supporting plate 13 is disposed under the tongue 12 and has a recess 132 facing toward the tongue 12. The base 11 has a first side surface 111 and a second side surface 112 respectively located at two opposite sides thereof. A plurality of first retaining slots 113 are recessed on the first side surface 111 respectively. A plurality of second retaining slots 114 are recessed on the second side surface 112 respectively. The tongue 112 has a plurality of grooves 120 arrayed along an upper-to-lower direction of the electrical connector 100 on two opposite sides thereof and in communicate with the first retaining slots 113 and the second retaining slots 114 respectively. The base 11 has a first retaining hole 115 and a second retaining hole 116 both of which pass through the base 11 along a thickness direction of the tongue 12. The first retaining hole 115 is disposed in front of the second retaining hole 116, and has a first retaining block 1150 located on an inner bottom wall thereof. The second retaining hole 116 has a second retaining block 1160 located on an inner bottom wall thereof. A rear end of the base 11 defines a cutout 118 passing therethrough along the thickness direction and located behind the first and the second retaining holes 115, 116, a first protrusion 1181 projecting upwardly into the cutout 118, and a second protrusion 1182 projection downwardly into the cutout 118. The first and the second protrusion 1181, 1182 are staggered with each other along the upper-to-lower direction.

The base 11 further defines three first resisting blocks 1113 protruding outwardly from the first side surface 111, a first retaining cavity 1111 formed among the first resisting blocks 1113, three second resisting blocks 1123 protruding outwardly from the second side surface 112, and a second retaining cavity 1121 formed among the second resisting blocks 1123. The first and the second retaining cavities 1111, 1121 are in communicate with the first and the second retaining slots 113, 114 respectively. Two first resisting blocks 1113 and two second resisting blocks 1123 are located at a top portion and a bottom portion of a front end of the base 11 respectively. The other first resisting block 1113 and the other second resisting block 1123 are located at a bottom end of the rear end of the base 11.

The first insulator 2 and the second insulator 3 are spaced from each other along the thickness direction to sandwiched the base 11 of the housing 1 therebetween. Both of the first insulator 2 and the second insulator 3 do not protrude beyond the base 11 neither in the upper-to-lower nor in a front-to-back direction of the electrical connector 100. The first insulator 2 has a first extensive arm 21, a first flexible arm 22, and two rows of first projectors 23 all of which protrude inwardly toward the second insulator 3, respectively. The first extensive arm 21 has a first locking block 210 protruding downwardly and disposed at a distal end thereof. The first flexible arm 22 has a first retention block 220 protruding downwardly and disposed at a distal end thereof. One row of the first projectors 23 are disposed at a front end of the first insulator 2 and arranged in the upper-to-lower direction. The other row of the first projectors 23 are disposed at a bottom portion of the first insulator 2 and arranged along the front-to-back direction. The first insulator 2 further defines three notches 24 adjacent to the projectors 23 and receiving the first resisting blocks 1113 therein.

The second insulator 3 has a second extensive arm 31, a second flexible arm 32, and two rows of second projectors 33 all of which protrude inwardly toward the first insulator 2, respectively. The second extensive arm 31 has a second locking block 310 protruding downwardly and disposed at a distal end thereof. The second flexible arm 32 has a second retention block 320 protruding upwardly and disposed at a distal end thereof. One row of the second projectors 33 are disposed at a front end of the second insulator 3 and arranged in the upper-to-lower direction. The other row of the second projectors 33 are disposed at a bottom portion of the second insulator 3 and arranged along the front-to-back direction. The second insulator 3 further defines three notches 34 adjacent to the second projectors 33 and receiving the second resisting blocks 1123 therein.

Figure 8:
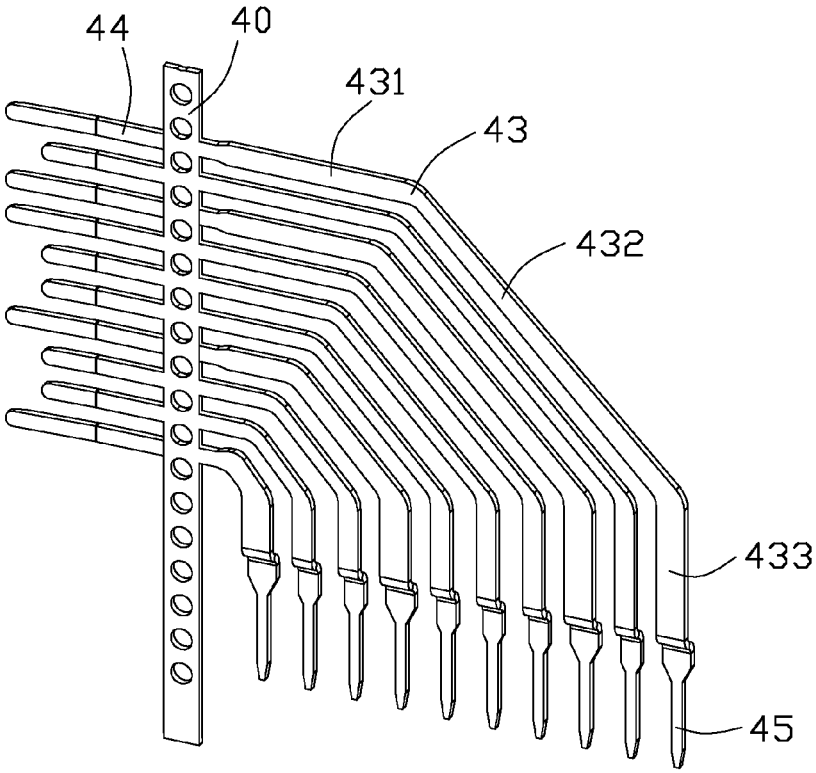
FIG. 8 is a schematic view illustrating one row of contacts of the electrical connector shown in FIG. 1, wherein the contacts have a contact carry.

The contacts 4 comprise a plurality of first contacts 41 arranged in a first vertical plane, and a plurality of second contacts 42 arranged in a second vertical plane and parallel to the first contacts 41. Each contact 4 has a retaining portion 43, a contact portion 44 extending forwardly from the retaining portion 43, and a tail portion 45 extending downwardly out of the housing 1. The retaining portion 43 includes a horizontal portion 431 connected to the contact portion 44, a vertical portion 433 connected to the tail portion 45, and an inclined portion 432 between the horizontal portion 431 and the vertical portion 432. The first contacts 41 and the second contacts 42 are formed from a metal sheet respectively. Referring to FIG. 8, for example, a method of making the second contact 42 as follows. Firstly, stamping a piece of metal sheet to the second contacts 42 with a contact carry 40. The contact carry 40 extends along the upper-to-lower direction and is perpendicular to the horizontal portion 431. Each two adjacent horizontal portions 431 are connected to each other by the contact carry 40. The contact carry 40 is located adjacent to the contact portions 44. In a process of electroplating for the contact portions 44, a brush (not shown) which adsorbs electroplating baths and brushes the contact portions 44 during the contact carry 40 is secured by a device (not shown). As a result, it is easily to avoid other portions of the second contacts 42 to be electroplated but the contact portions 44. The contact carry 40 is cut out after the process of electroplating. Two cross sections 401 are formed at opposite sides of each horizontal portion 431 after the contact carry 40 is cut out.

The metal shell 5 surrounds around the tongue 12 to define a mating port 50 therebetween for receiving the corresponding plug, and includes a top plate 51, a bottom plate 52, and two opposite side plates 53 extending from to top plate 51 to the bottom plate 52. The top plate 51, the bottom plate 52 and the side plates 53 each defines at least one spring 58 protruding into the mating port 50 for locking with the corresponding plug. The supporting plate 13 supports the bottom plate 52 of the metal shell 5 upwardly. The spring 58 can enter into the recess 132 when being abutted against by the corresponding plug.

In assembly, firstly, assembling the first contacts 41 and the second contacts 42 to the housing 1 along the thickness direction respectively, then the retaining portions 43 of the first contacts 41 are retained in the first retaining slots 113, the retaining portions 43 of the second contacts 42 are retained in the second retaining slots 114, the contact portions 44 of the first and the second contacts 41, 42 are received in the grooves 120 and exposed to the mating port 50, the cross sections 410 are received by inner walls of the grooves 120. Secondly, assembling the first and the second insulator 2, 3 to the housing 1 along the thickness direction of the tongue portion 12, the first insulator 2 is retained in the first retaining cavity 1111, the second insulator 3 is retained in the second retaining cavity 1121. The first extensive arm 21 is inserted into the first retaining hole 115, and the first locking block 210 latches with the first retaining block 1150 to prevent the first insulator 2 from moving away from the housing 1 along the thickness direction. Besides, the first flexible arm 22 is inserted into the cutout 118 of the housing 1 to urge the first retention block 220 to latch with the first protrusion 1181 to prevent the first insulator 2 from moving away from the housing 1 along the thickness direction. The first projectors 23 abut inwardly against the corresponding horizontal portions 431 and the vertical portions 433 of the first contacts 41 after projecting into the corresponding first retaining slots 113 in condition that the first contacts 41 are sandwiched between the housing 1 and the first insulator 2 along the thickness direction.

The second extensive arm 31 is inserted into the second retaining hole 116, and the second locking block 310 latches with the second retaining block 1160 to prevent the second insulator 3 from moving away from the housing 1 along the thickness direction. Besides, the second flexible arm 32 is inserted into the cutout 118 of the housing 1 to urge the second retention block 320 to latch with the second protrusion 1182 to prevent the second insulator 3 from moving away from the housing 1 along the thickness direction. The second projectors 33 abut inwardly against the corresponding horizontal portions 431 and the vertical portions 433 of the second contacts 42 after projecting into the corresponding second retaining slots 114 in condition that the second contacts 42 are sandwiched between the housing 1 and the second insulator 3 along the thickness direction. The first resisting blocks 1113 and the second resisting blocks 1123 are received in the notches 24, 34 of the first insulator 2 and the second insulator 3 respectively to prevent the first insulator 2 and the second insulator 3 from moving both in the upper-to-lower direction and the front-to-back direction. Finally, assembling the metal shell 5 to cover the housing 1, the first insulator 2 and the second insulator 3.

As fully described above, The housing 1 is retained reliably via the housing 1 is sandwiched between the first insulator 2 and the second insulator 3. The first contacts 41 are sandwiched between the housing 1 and the first insulator 2, the second contacts 42 are sandwiched between the housing 1 and the second insulator 42, which can assure the electrical connector 100 being in assembling conveniently.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector, comprising:

an insulative housing having a base with two opposite sides, and a tongue extending forwardly from the base;

a first insulator attached to one side of the base which defines a plurality of first retaining slots;

a second insulator attached to the other side of the base which defines a plurality of second retaining slots;

a metal shell covering the housing, the first insulator and the second insulator, and surrounding around the tongue to define a mating port therebetween; and a plurality of contacts including a first set of contacts, and a second set of contacts, the contacts each having a contact portion located at the tongue and exposed to the mating port, a tail portion extending out of the housing, and a retaining portion between the contact portion and the tail portion;

wherein the retaining portions of the first contacts are retained in the first retaining slots, the retaining portions of the second contacts are retained in the second retaining slots, respectively.

2. The electrical connector according to claim 1, wherein the first insulator and the second insulator are retained to the base, and do not protrude beyond the base both neither in an upper-to-lower direction nor in a front-to-back direction.

3. The electrical connector according to claim 1, wherein the first insulator has a first extensive arm extending toward the second insulator and a first locking block formed at a distal end of the first extensive arm, the housing has a first retaining hole receiving the first extensive arm therein and a first retaining block located in the first retaining hole and latching with the first locking block to prevent the first insulator from moving away from the housing along a thickness direction of the tongue perpendicular to the front-to-back direction.

4. The electrical connector according to claim 3, wherein the second insulator has a second extensive arm extending toward the first insulator, and a second locking block formed at a distal end of the second extensive arm, the housing has a second retaining hole receiving the second extensive arm therein, and a second retaining block located in the second retaining hole and latching with the second locking block to prevent the second insulator from moving away from the housing along the thickness direction, the second retaining hole is disposed behind the first retaining hole.

5. The electrical connector according to claim 1, wherein the housing has a cutout located at a rear end thereof, and two protrusions located in the cutout, the first insulator has a first flexible arm received in the cutout, which is formed with a first retention block latching with one of the two protrusions for preventing the first insulator from moving away from the housing along the thickness direction, the second insulator has a second flexible arm received in the cutout, which is formed with a second retention block latching with the other protrusion for preventing the second insulator from moving away from the housing along the thickness direction.

6. The electrical connector according to claim 1, wherein the base has a first side surface, and a second side surface opposite to the first side surface, the first and the second retaining slots are recessed on the first and the second side surface respectively, the first insulator has at least one row of first projectors abuting inwardly against the retaining portions of the first contacts after projecting into the corresponding first retaining slots, the second insulator has at least one row of second projectors abuting inwardly against the retaining portions of the second contacts after projecting into the corresponding second retaining slots.

7. The electrical connector according to claim 6, wherein the retaining portions each has a horizontal portion connected to the contact portion, a vertical portion connected to the tail portion, and an inclined portion extending slantwardly and disposed between the horizontal portion and the vertical portion, the first and the second projectors are arrange in two row, one row of the first and the second projectors abut against the horizontal portions, the other row of first and the second projectors abut against the vertical portions.

8. The electrical connector according to claim 1, wherein the base has a plurality of resisting blocks protruding outwardly, the first and the second insulator each has a plurality of notches located at lateral sides thereof and receiving the resisting blocks therein for preventing the first and the second insulator from moving both in the upper-to-lower direction and in the front-to-back direction.

9. The electrical connector according to claim 1, wherein the first contacts are located in a vertical plane and are formed from a metal sheet, a vertical contact carry connected to front ends of the retaining portions before the first contacts is assembled in the housing.

10. An electrical connector, comprising:

a first set of contacts located in a first vertical plane, each of the first contacts defining a first retaining portion, a first contact portion extending forwardly from a front end of the first retaining portion, and a first tail portion extending from a rear end of the first retaining portion;

a second set of contacts located in a second vertical plane parallel to the first vertical plane, each of the second contacts defining a second retaining portion, a second contact portion extending forwardly from a front end of the first second retaining portion, and a second tail portion extending from a rear end of the second retaining portion;

an insulative housing including a base, and a tongue extending forwardly from the base for the first and the second contact portions being located on;

a first insulator retained on the base to hold the first retaining portions of the first contacts between the first insulator and the base; and a second insulator retained on the base to hold the second retaining portions of the second contacts between the second insulator and the base, and isolated from the first insulator by the base along a thickness direction of the tongue.

11. The electrical connector according to claim 10, wherein the housing is configured to allow the first contacts, the second contact, the first insulator, and the second insulator to be assembled therein along the thickness direction.

12. The electrical connector according to claim 10, wherein the base has two opposite sides each defines a plurality of retaining slots for the first and the second retaining portions retained therein, the first and the second insulators each defines at least one row of projectors abuting inwardly against the first and the second retaining portions after projecting into the retaining slots respectively.

13. An electrical connector comprising:

an upright insulative base defining two opposite first sand second sides in a transverse direction;

a plurality of first contacts located on the first side;

a plurality of second contacts located on the second side;

a first insulator defining a first face to abut against the first side and cooperate with the first side to sandwich the first contacts therebetween in the transverse direction;

a plurality of first retaining slots formed in either the first side or the first face to receive the corresponding first contacts, respectively, under condition that the first contacts are allowed to be respectively assembled into the corresponding first retaining slots in only the transverse direction;

a second insulator defining a second face to abut against the second side and cooperate with the second side to sandwich the second contacts therebetween in the transverse direction;

a plurality of second retaining slots formed in either the second side or the second face to receive the corresponding second contacts, respectively, under condition that the second contacts are allowed to be respectively assembled into the corresponding second retaining slots in only the transverse direction.

14. The electrical connector as claimed in claim 13, wherein the first retaining slots and the second retaining slots are formed in the first side and the second side, respectively.

15. The electrical connector as claimed in claim 14, wherein a plurality of first ribs are formed on the first face to be received in the corresponding first retaining slots, respectively, for cooperating with the base to sandwich the first contacts in the transverse direction, and a plurality of second ribs are formed on the second face to be received in the corresponding second slots, respectively, for cooperating with the base to sandwich the second contacts in the transverse direction.

16. The electrical connector as claimed in claim 13, further including a metallic shell enclosing all the base, the first and second insulator.

17. The electrical connector as claimed in claim 16, wherein the base further includes a vertical mating tongue and a horizontal support plate below the vertical mating tongue.

18. The electrical connector as claimed in claim 17, wherein the shell encloses the mating tongue and defines a spring finger facing the mating tongue, and the support plate defines a recess into which said spring finger is deflected when a mating connector is inserted into the shell.

19. The electrical connector as claimed in claim 17, wherein the first contacts and the second contacts are located upon the mating tongue.

20. The electrical connector as claimed in claim 13, wherein the first insulator and the second insulator includes locking hooks assembled to the base.

* * * * *